United States Patent [19]

Gibbs

[11] Patent Number: 4,848,843

[45] Date of Patent: Jul. 18, 1989

[54] MULTIPLE SEAT CHAIR STRUCTURE

[75] Inventor: Terence E. Gibbs, Grandview, N.Y.

[73] Assignee: Omni Products International, Inc., Fairfield, N.J.

[21] Appl. No.: 229,874

[22] Filed: Aug. 8, 1988

[51] Int. Cl.[4] ..... A47C 4/00; A47C 17/02

[52] U.S. Cl. ..... 297/440; 248/188; 297/226; 297/232; 297/248; 297/441

[58] Field of Search ..... 297/440, 441, 444, 443, 297/445, 449, 226, 232, 248; 248/188

[56] References Cited

U.S. PATENT DOCUMENTS

| | | | |
|---|---|---|---|
| 3,482,874 | 12/1969 | Henebny et al. | 297/445 |
| 3,640,576 | 2/1972 | Morrison et al. | 297/248 X |
| 3,929,376 | 12/1975 | Kates | 248/188 X |
| 4,265,483 | 5/1981 | Raftery et al. | 297/232 X |
| 4,395,071 | 7/1983 | Laird | 297/440 |

FOREIGN PATENT DOCUMENTS

| | | | |
|---|---|---|---|
| 31154 | 12/1907 | Austria | 248/188 |
| 2338020 | 8/1977 | France | 297/440 |

*Primary Examiner*—Peter R. Brown

*Attorney, Agent, or Firm*—Lerner, David, Littenberg, Krumholz & Mentlik

[57] ABSTRACT

An improved multiple seat chair structure is disclosed which includes a pair of longitudinally spaced, vertically oriented, end support members; a longitudinally extending brace member fixed to and interconnecting the end support members; at least one intermediate support member positioned between the end support members, each of the intermediate support members including a vertically extending leg member thereon having an upper end portion; first and second seat sections carried by the various support members, the seat sections each including first and second side rail members thereon and a seat member extending between and supported by the side rail members; and at least one generally wedge-shaped fitting rigidly interconnecting the leg member, the brace member and at least one of the side rail members from each of two of the seat sections. The fitting preferably includes a first, generally planar, surface thereon on which the side rail members are seated; elements for fastening the side rail members to the first surface; a second, generally partially cylindrical, surface in which a portion of the brace member is seated; a third, generally planar, surface thereon on which the remainder of the brace member is seated and on which the leg member is seated; and elements for fastening the brace member and the leg member to the third surface.

23 Claims, 7 Drawing Sheets

MULTIPLE SEAT CHAIR STRUCTURE

BACKGROUND OF THE INVENTION

This invention relates to lightweight chair structures, such as those designed for outdoor use on lawns, patios and the like, and, more particularly, to such lightweight chair structures in which multiple seats are provided.

Conventional lightweight chair structures are generally provided with single seats therein. Although various attempts have been made to produce lightweight multiple seat chair structures, such multiple seat chair structures have heretofore not been satisfactory in many respects. One of the main reasons for this is that lightweight multiple seat chair structures have not heretofore had the strength and rigidity to withstand the loads imposed on them in service without bending or deflecting. Moreover, they have not heretofore provided the user with the feeling of strength and rigidity normally found in heavier multiple seat chair structures designed for indoor use.

It is, therefore, a primary object of the present invention to provide an improved lightweight multiple seat chair structure that has sufficient strength and rigidity to withstand normal loads found in service.

Another object of the present invention is to provide an improved lightweight multiple seat chair structure that provides the user with the feeling of strength and rigidity that the user normally associates with heavier multiple seat chair structures designed for indoor use.

Further objects and advantages of the present invention will become apparent as the following description proceeds.

SUMMARY OF THE INVENTION

Briefly stated, and in accordance with one embodiment of this invention, an improved multiple seat chair structure preferably includes a pair of longitudinally spaced, vertically oriented, end support members; a longitudinally extending brace member fixed to and interconnecting the end support members; at least one intermediate support member positioned between the end support members, each of the intermediate support members including a vertically extending leg member thereon having an upper end portion; first and second seat sections carried by the various support members, the seat sections each including first and second side rail members thereon and a seat member extending between and supported by the side rail members; and at least one generally wedge-shaped fitting rigidly interconnecting the leg member, the brace member and at least one of the side rail members from each of two of the seat sections. The fitting preferably includes a first, generally planar, surface on which the side rail members are seated; means for fastening the side rail members to the first surface; a second, generally partially cylindrical, surface in which a portion of the brace member is seated; a third, generally planar, surface on which the remainder of the brace member is seated and on which the leg member is seated; and means for fastening the brace member and the leg member to the third surface.

BRIEF DESCRIPTION OF THE DRAWINGS

While the specification concludes with claims particularly pointing out and distinctly claiming the subject matter regarded as the invention herein, it is believed that the present invention will be more readily understood from the following description, taken in conjunction with the accompanying drawings, in which:

DETAILED DESCRIPTION OF THE INVENTION

Figure 1:
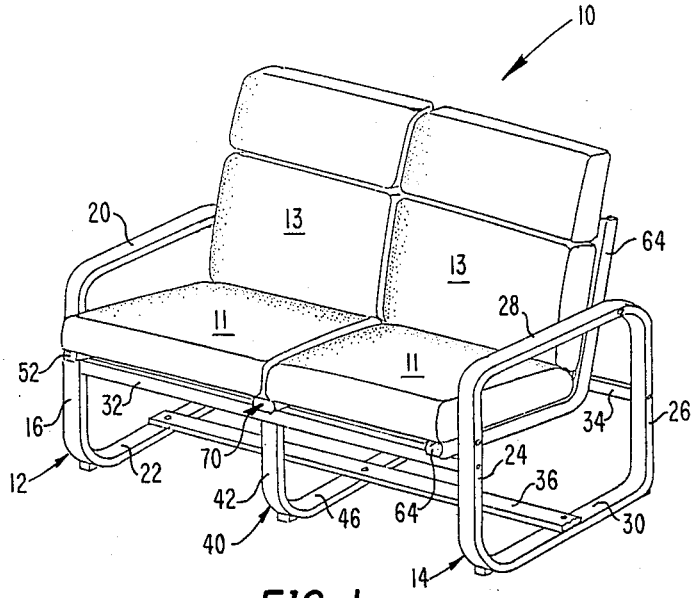
FIG. 1 is a perspective view of a two seat chair structure made in accordance with one embodiment of this invention.

Referring to FIGS. 1 and 3–9, a two seat chair structure or love seat, shown generally at 10, has there been illustrated. The chair structure 10 includes a pair of longitudinally spaced, vertically oriented, end support members 12 and 14, seat cushions 11 and back rest cushions 13. End support member 12 comprises transversely spaced, vertically extending, front and rear leg portions 16 and 18, respectively, and vertically spaced, transversely extending, upper and lower portions 20 and 22, respectively. Similarly, end support member 14 comprises transversely spaced, vertically extending, front and rear leg portions 24 and 26, respectively, and vertically spaced, transversely extending, upper and lower portions 28 and 30, respectively.

The chair structure 10 also includes transversely spaced, longitudinally extending, front and rear brace members 32 and 34, respectively, which are fixed to and interconnect the respective front leg portions 16 and 24 and rear leg portions 18 and 26 of the end support members 12 and 14, intermediate the upper and lower portions thereof. The chair structure 10 also includes an intermediate brace member 36 that is fixed to and interconnects the lower portions 22 and 30 of the end support members 12 and 14, respectively.

The two seat chair structure 10 shown in FIGS. 1 and 3–9 further includes a vertically oriented, generally U-shaped, intermediate support member, shown generally at 40. The intermediate support member 40 is positioned between and longitudinally spaced from each of the end support members 12 and 14 and includes a generally vertically oriented front leg portion 42, a generally vertically oriented rear leg portion 44, and a transversely extending lower portion 46 that is fixed to and interconnects the lower ends of the front and rear leg portions 42 and 44, respectively. The transversely extending lower portion 46 of the intermediate support member 40 is also fixed to the intermediate brace member 36 so that the structure comprising the end support members 12 and 14, the intermediate support member 40, and the various braces 32, 34 and 36 forms a rigid frame for the chair structure 10.

The two seat chair structure 10 includes first and second seat sections, shown generally at 48 and 50, respectively. Seat section 48 comprises first and second side rail members 52 and 54, respectively, and a seat member 56 extending between and supported by the side rail members 52 and 54. A curved back brace 53 and a curved seat brace 55 rigidly interconnect the side rail members 52 and 54. Side rail member 52 rests upon the top edge of forward transverse brace 32 and is bolted or otherwise fastened to the front and rear leg portions 16 and 18 of end support member 12 by suitable bolts (not shown). The manner in which side rail member 54 is supported will be described in detail hereinafter.

Similarly, seat section 50 comprises first and second side rail members 62 and 64, respectively, and a seat member 66 that extends between and is supported by the side rail members 62 and 64. A curved back brace 63 and a curved seat brace 65 rigidly interconnect the side rail members 62 and 64, as in the case of seat section 48. Side rail member 64 also rests upon the top edge of forward transverse brace 32 and is bolted or otherwise fastened to the front and rear leg portions 24 and 26 of end support member 14 by suitable bolts (not shown). The manner in which side rail member 62 is supported will also be described in detail hereinafter.

The various end support members, intermediate support members and side rail members utilized in the chair structure 10 are preferably made from a rigid plastic material, for example polyvinylchloride, and are either extruded or molded from such material. Alternative materials, such as extruded aluminum or plastic coated or painted steel tubing, may also be used for such components.

The side rail members 54 and 62 are preferably formed from a single extrusion, shown generally at 70 (FIG. 5), which includes web portions 72 and 74 that interconnect the two side rail members 54 and 62. The various side rail members 52, 54, 62 and 64 are each provided with respective inverted T-shaped slots 76, 78, 80 and 82 therein which slidingly receive respective enlarged end portions 84, 86, 88 and 90 of the seat members 56 and 66. The seat members 56 and 66 are preferably made of flexible textile or plastic mesh material and the enlarged end portions 84, 86, 88 and 90 thereof each include respective openings 92, 94, 96 and 98 therein that, in turn, are provided with respective elastomeric rods 100, 102, 104 and 106 therein which expand the flexible end portions of the seat members to retain them in place within the inverted T-shaped slots.

Preferably, the various side rail members 52, 54, 62 and 64 (FIG. 3) are L-shaped to provide generally horizontally extending portions **52*a*, 54*a*, 62*a*, and 64*a* and to provide generally vertically extending portions thereon 52*b*, 54*b*, 62*b*, and 65*b*. The flexible seat members 56 and 66 conform to the shapes of the side rail members and, thus, the seat sections 56 and 66 include respective generally horizontal seat portions 56*a* and 66*a* and generally vertical backrest portions 56*b* and 66*b***.

Referring more particularly now to FIGS. 4 and 6–8, the rear, vertical, portion of the single extrusion 70 that comprises the second side rail 54 of the first seat section 48 and the first side rail member 62 of the second seat section 50 is rigidly connected to the rear leg member 44 of intermediate support member 40 and to the rear transverse brace 34 via a wedge-shaped bracket or fitting, shown generally at 110. Wedge-shaped fitting 110, which is preferably a molded rigid plastic or metal fitting, includes a first, preferably generally planar, surface 112 thereon having internally threaded inserts 114 and 116 therein. The extrusion 70 seats on the planar surface 112 and is fastened thereto by means of bolts 118 and 120 which are threaded into the inserts 114 and 116.

Wedge-shaped fitting 110 also includes a second surface 122 thereon, which is preferably partially cylindrical in shape, in which a rounded edge portion 124 of transverse brace 34 is seated. The wedge-shaped fitting further includes a third, preferably generally planar, surface 126 thereon having an upper pair of apertures, one of which is shown at 128, and a lower pair of apertures, one of which is shown at 132, therein. The rear transverse brace 34 is seated aginst and fastened to the upper portion of planar surface 126 via a pair of bolts, one of which is shown at 136, which cooperate with corresponding nuts, one of which is shown at 138. The head portion of bolt 136 is hidden within the transverse brace 34 and seats on an elongated cylindrical washer 140. A snap on cap 142 covers an access hole 144 through which the head of the bolt 136 may be engaged by a suitable screwdriver or other tool (not shown) during assembly of the chair structure.

The rear leg 44 of intermediate support member 40 includes an upper end portion 146 thereon which abuts against a lower rounded edge portion 148 of rear brace 34 and assists the bolts 136 and nuts 138 in firmly locking the rear brace 34 and the wedge-shaped fitting 110 together. The upper portion of rear leg 44, adjacent to the end portion 146 thereof, is rigidly bolted to the lower portion of the planar surface 126 via a pair of bolts and nuts, respective ones of which are shown at 150 and 152. As may be seen in FIG. 6, the planar surfaces 112 and 126 include an acute angle between them. Also, the partially cylindrical surface 122 and the planar surface 126 of the fitting merge into one another. Thus, the wedge-shaped fitting 110 rigidly connects together the extrusion 70, the rear transverse brace 34 and the rear leg 44 of intermediate support member 40, allowing the rear leg 44 of intermediate support member 40 to support the rear portion of the load which occurs when one or more persons occupy one or the other or both of seat sections 48 and 50.

Figure 3:
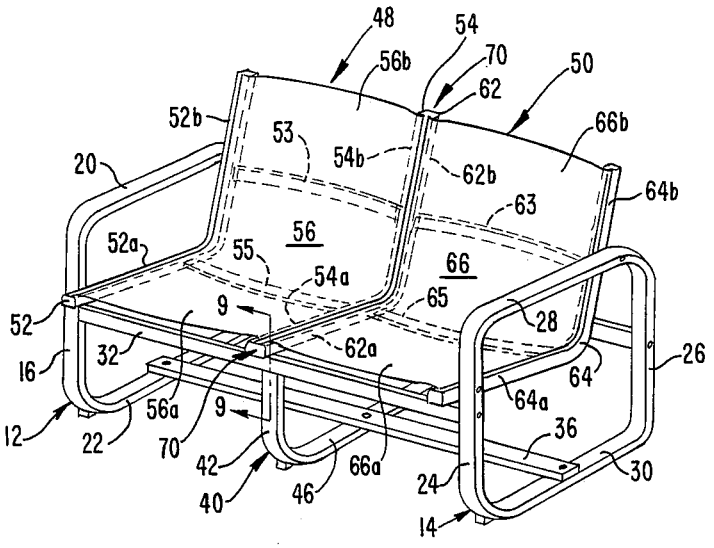
FIG. 3 is a perspective frontal view of the two seat chair structure of FIG. 1, with the seat cushions and back rest cushions thereof removed.
Figure 4:
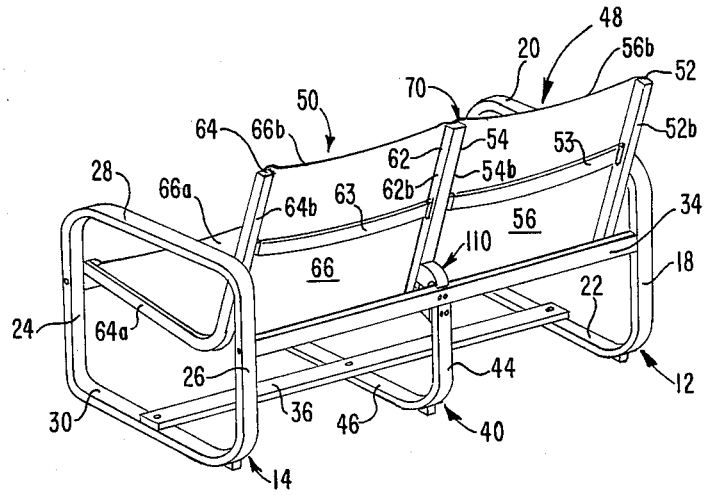
FIG. 4 is a perspective view of the rear of the chair structure shown in FIG. 3.
Figure 5:
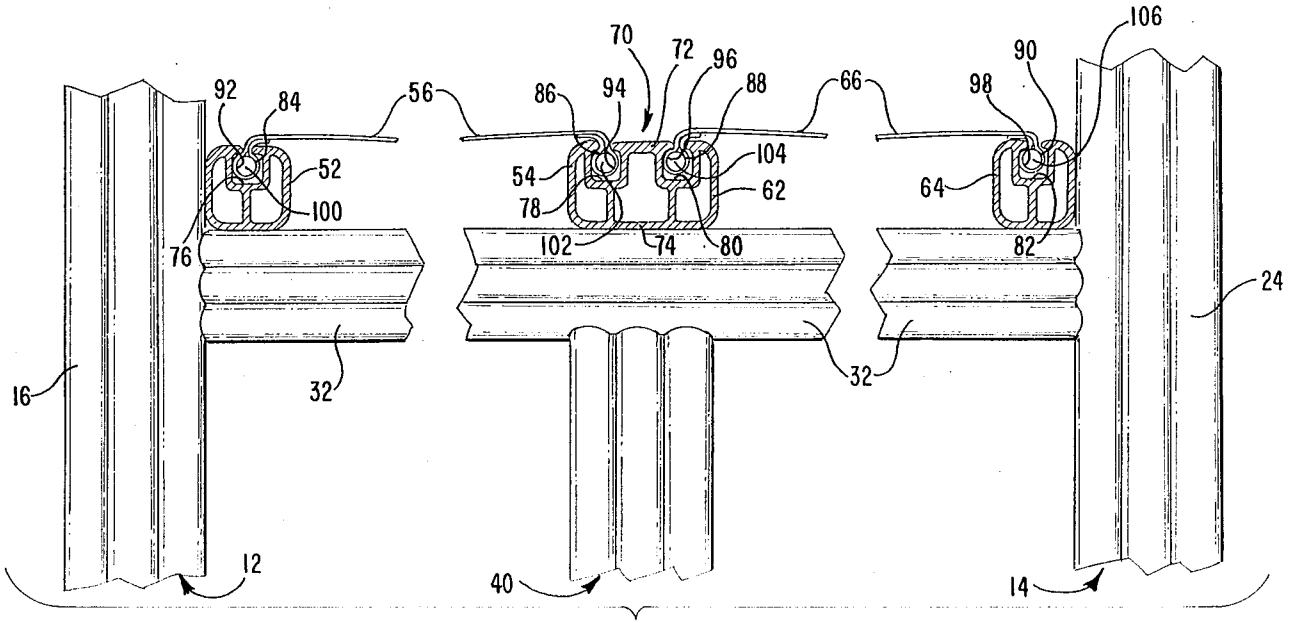
FIG. 5 is an enlarged front elevation view, with parts omitted and cut away for clarity, of the two seat chair structure of FIG. 3, showing cross-sectional details of side rail members and seat members utilized in the chair structure.
Figure 6:
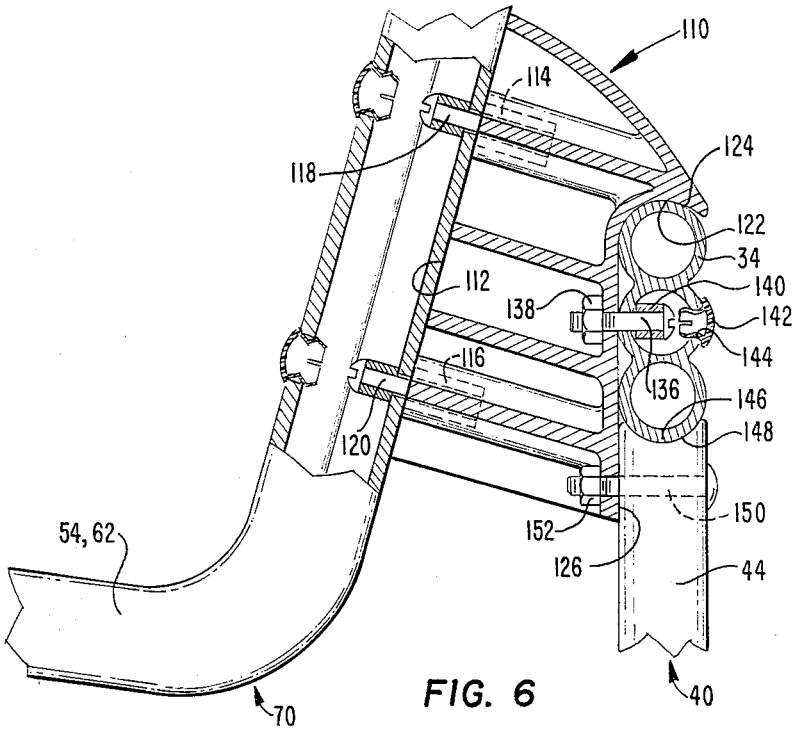
FIG. 6 is a fragmentary elevation view, with parts cut away for clarity, of a fitting used in the chair structure to rigidly interconnect various structural parts at the rear thereof.
Figure 7:
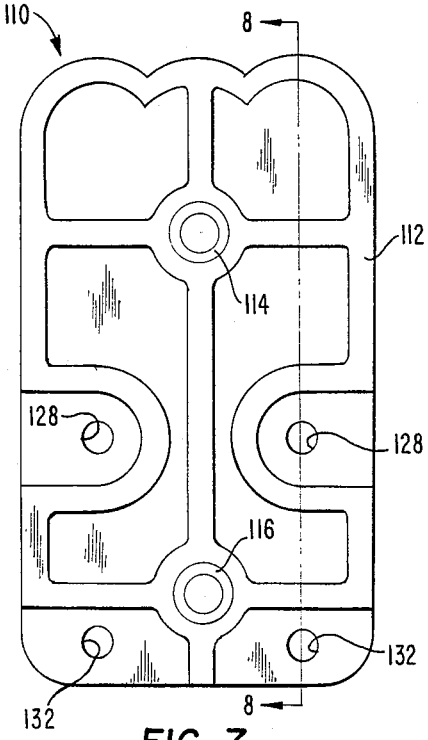
FIG. 7 is an end elevation view of the fitting shown in FIG. 6.
Figure 8:
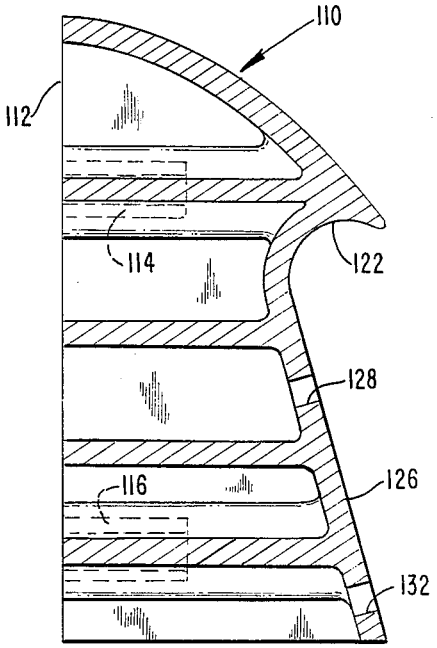
FIG. 8 is a sectional elevation view, taken along the line 8—8 of FIG. 7, of the fitting shown in FIG. 6.
Figure 9:
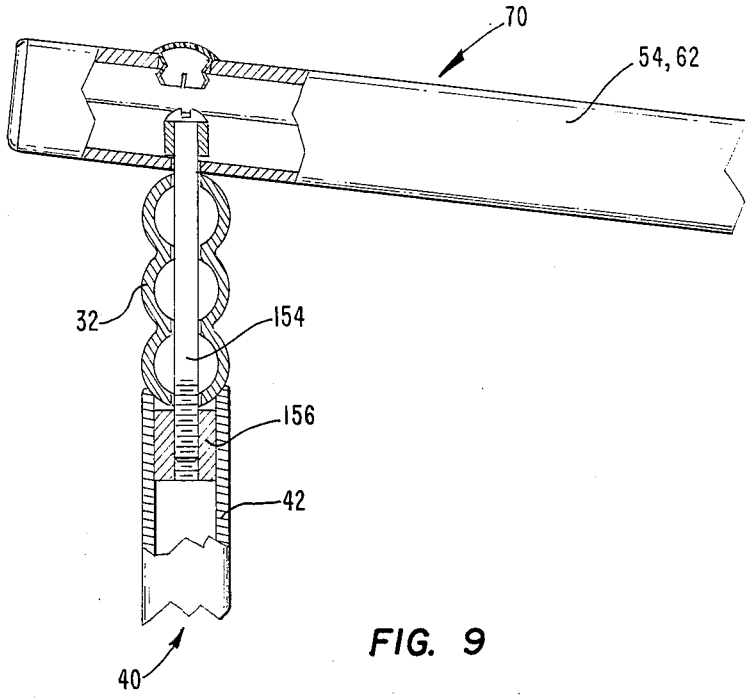
FIG. 9 is an enlarged fragmentary sectional view, taken along the line 9—9 of FIG. 3, showing the manner in which various structural parts at the front of the chair structure are rigidly interconnected to one another in accordance with one embodiment of this invention.

Referring to FIGS. 3 and 9, the forward horizontal portion of the extrusion 70, in the preferred embodiment of this invention, rests upon the top edge of front transverse side rail 32. The bottom edge of brace 32, in turn, rests upon and is supported by the upper portion of forward leg 42 of intermediate support member 40. Extrusion 70 is fastened to brace 32 and the upper end of leg 42 by means of a threaded bolt 154 which passes through aligned apertures (not shown) in brace 32 and threadedly engages an internally threaded insert 156 that is secured to the interior of the upper end of leg 42. Accordingly, the load imposed on the forward portion of the seat sections 48 and 50 by one or more persons occupying the seat sections is transferred via the side rails 54 and 62 of extrusion 70 onto the top of the forward transverse brace member 32 and, from there, to the forward leg member 42 of the intermediate support member 40, the lower portion 46 of which contacts, and transfers the load to, the floor on which the chair 10 rests.

Figure 12:
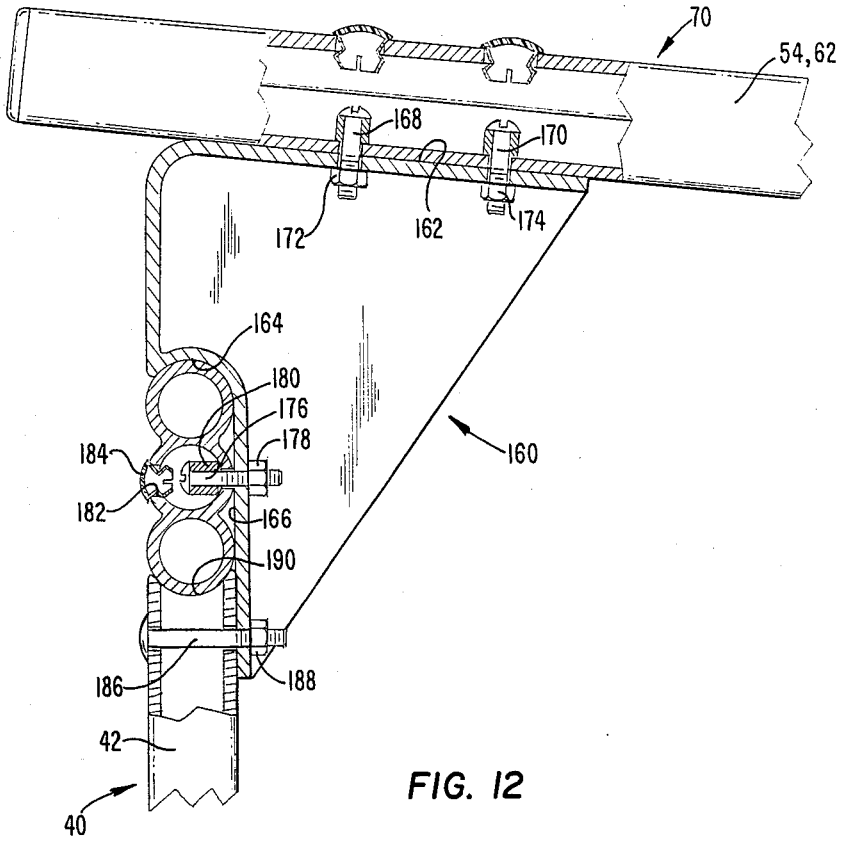
FIG. 12 is an enlarged fragmentary sectional elevation view, taken along the line 12—12 of FIG. 11, showing details of the fitting employed in the embodiment of FIG. 11.
Figure 11:
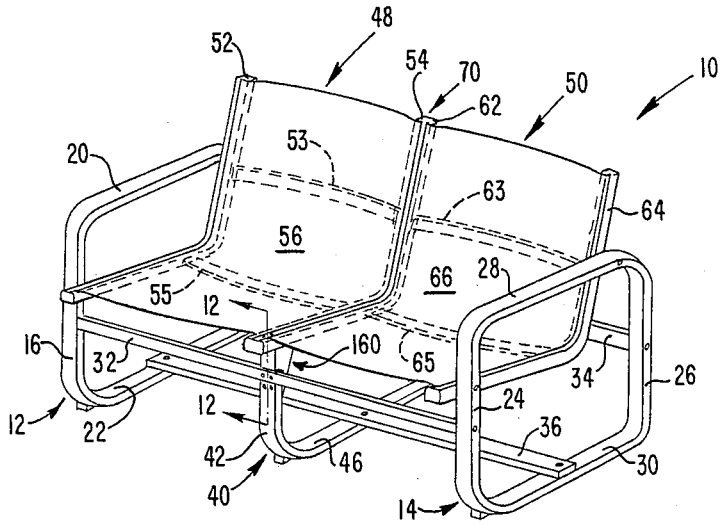
FIG. 11 is a perspective view of an alternate form of two seat chair construction, with the seat cushions and back rest cushions thereof removed, in which an alternate form of fitting is used in the chair structure to rigidly interconnect various structural parts at the front thereof.

Referring to FIGS. 11 and 12, an alternate arrangement, employing a second wedge-shaped fitting or bracket 160, is illustrated by which the forward, horizontal, portion of the single extrusion 70 is rigidly connected to the upper portion of the forward leg 42 of intermediate support member 40 and to the forward transverse brace 32. As in the case of the rear wedge-shaped fitting 110, the forward wedge-shaped fitting 160 includes a first, preferably generally planar, surface 162, a second, preferably generally partially cylindrical, surface 164 and a third, preferably generally planar, surface 166, which merges into and forms a continuation of the partially cylindrical surface 164. Planar surfaces 162 and 164 include an acute angle between them.

As in the case of the rear wedge-shaped fitting 110, the forward portion of extrusion 70 is bolted against the surface 162 of the forward wedge-shaped fitting 160 by means of bolts 168 and 170 which are threadedly engaged by respective nuts 172 and 174. Also, suitable bolts 176, nuts 178 and elongated cylindrical washers 180 are provided to bolt the forward transverse brace 32 against the surfaces 164 and 166 of the forward wedge-shaped fitting 160, and an access aperture 182 which is closed by a cap member 184, is provided, as in the case of the rear wedge-shaped fitting 110. In addition, the upper portion of the front leg 42 of intermediate support member 40 is securely fastened to the surface 166 of wedge-shaped fitting 160 via bolts 186 and nuts 188, and the upper end 190 of forward leg member 42 abuts against the lower, rounded edge of transverse brace member 32 to assist in holding the brace member rigidly in place on the fitting 160.

Thus, the load imposed on the forward portion of the seat sections 48 and 50 by one or more persons occupying the seat sections is transferred via the side rails 54, 62 of extrusion 70 onto the forward wedge-shaped fitting 160 and, from there, to the forward transverse brace member 32 and the forward leg member 42 of the intermediate support member 40, the lower portion 46 of which contacts, and transfers the load to, the floor on which the chair 10 rests.

Figure 2:
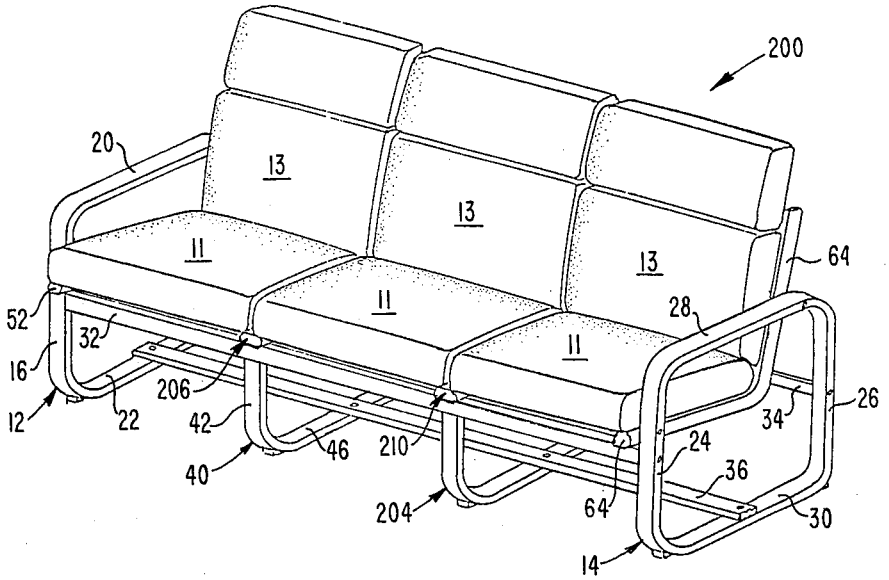
FIG. 2 is a perspective view of a three seat chair structure made in accordance with another embodiment of this invention.
Figure 10:
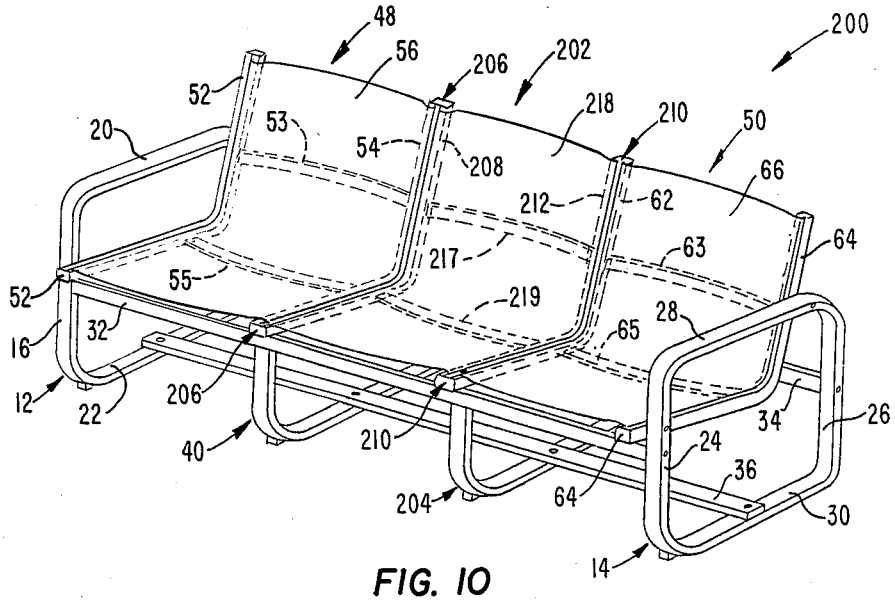
FIG. 10 is a perspective view of the three seat chair structure of FIG. 2, with the seat cushions and back rest cushions thereof removed.

Referring to FIGS. 2 and 10, a three seat chair structure or couch, shown generally at 200, has there been illustrated. The chair structure 200 is essentially similar to the two seat chair structure 10 shown in FIGS. 1 and 3–9, except that it includes an extra, third, seat section, shown generally at 202, between the first and second seat sections 48 and 50 described in connection with the two seat chair structure 10. Also, a second intermediate support member, shown generally at 204, is provided between the intermediate support member 40 and the end support member 14. In addition, the extrusion 70, which in the two seat chair structure version of the invention comprises the side rails 54 and 62, now is identified as an extrusion 206 which includes the original side rail member 54 and a new first side rail member 208 of the seat section 202. Similarly, a second extrusion, shown generally at 210, is provided which comprises the former side rail 62 of seat section 50 and a second side rail member 212 of the new seat section 202. Extrusion 210 is supported on the support member 204 directly via the front transverse brace 32 and indirectly via the rear transverse brace 34 and a rear wedge-shaped fitting (not shown), which support arrangements correspond to the front and rear support arrangements of the two seat chair structure embodiment of FIGS. 1 and 3–9 and, thus, need not be described in greater detail herein. As before, the seat section 202 includes a seat member 218 that corresponds to the seat members 56 and 66 of the two seat chair structure embodiments. The seat member 218 extends between and is supported by the side rail members 208 and 212 in the same manner that the seat members 56 and 66 are supported in their respective side rail members in the two seat chair structure embodiments. Also, a curved back brace 217 and a curved seat brace 219 rigidly interconnect the side rail members 208 and 212.

Figure 13:
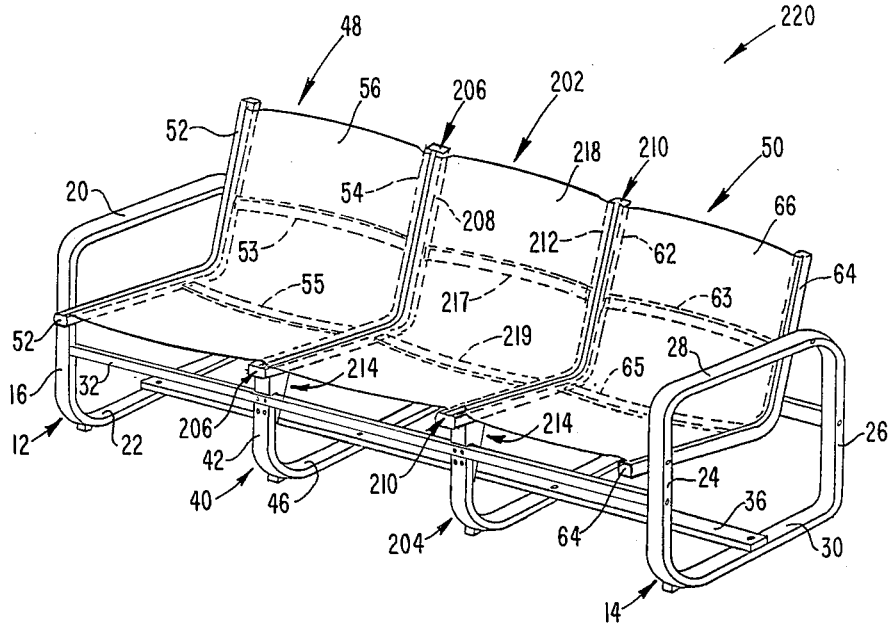
FIG. 13 is a perspective view of an alternate form of three seat chair construction, with the seat cushions and back rest cushions thereof removed, employing the fitting used in the embodiment illustrated in FIGS. 11 and 12.

Referring to FIG. 13, an alternate embodiment of a three seat chair structure has there been shown generally at 220. The alternate three seat chair structure 220 is essentially similar to the chair structure 200, except that it employs the wedge-shaped fitting or bracket 160 of the two seat chair structure illustrated in FIGS. 11 and 12 to indirectly support the forward ends of the extrusions 206 and 210 on the forward transverse brace 32 and on the forward legs of the respective intermediate support members 40 and 204.

From the foregoing description, it will be apparent that a number of improved lightweight multiple seat chair structures have been provided in which the various frame members thereof are rigidly joined together in manners that provide great strength and rigidity to multiple seat chair structures, allowing the users of the chair structures to have the same sense of security when seated in and occupying the lightweight multiple seat chair structures of this invention as the user associates with heavier multiple seat chair structures designed for indoor use.

While there have been shown and described what are presently considered to be the preferred embodiments of this invention, it will be obvious to those skilled in the art that various changes and modifications may be made without departing from the broader aspects of this invention. It is, therefore, aimed in the appended claims to cover all such changes and modifications as fall within the true spirit and scope of this invention.

What is claimed is:

1. A multiple seat chair structure, comprising a pair of longitudinally spaced, vertically oriented, end support members; a pair of transversely spaced, longitudinally extending brace members fixed to and interconnecting the end support members; at least one intermediate support member positioned between the end support members, said intermediate support member including a vertically extending leg member thereon having an upper end portion; first and second seat sections carried by the support members, said seat sections each including first and second side rail members thereon and a seat member extending between and supported by said side rail members; and at least one fitting rigidly interconnecting said leg member, one of said brace members and at least one of the side rail members from each of two of said seat sections, said fitting having a first surface thereon on which said side rail members are seated, said fitting including means for fastening said side rail members to said first surface, said fitting having a second surface thereon in which a portion of said one brace member is seated and having a third surface thereon on which the remainder of said one brace member is seated and on which said leg member is seated, said fitting further including means for fastening said one brace member and said leg member to said third surface.

2. A multiple seat chair structure according to claim 1, wherein said first and third surfaces are generally planar surfaces the extensions of which include an acute angle therebetween.

3. A multiple seat chair structure according to claim 2, wherein said second surface comprises a partially cylindrical surface, and wherein said partially cylindrical surface and said third planar surface merge into one another.

4. A multiple seat chair structure according to any one of claims 1 to 3, wherein said brace member is generally rectangular in cross-section and includes first and second spaced apart, rounded, narrow, side portions thereon and first and second, wider, face portions thereon, wherein one of said rounded side portions is seated against said partially cylindrical surface, and wherein said end portion of said leg member abuts against the other of said rounded side portions.

5. A multiple seat chair structure according to any one of claims 1 to 3, wherein said chair structure includes one intermediate support member, wherein the second side rail of said first seat section and the first side rail of said second seat section are located centrally of the chair seat structure, and wherein the second side rail member of said first seat section and the first side rail member of said second seat section are fixed to and supported by said fitting.

6. A multiple seat chair structure according to claim 5, wherein the second side rail member of said first seat section and the first side rail member of said second seat section are integral with one another.

7. A multiple seat chair structure according to claim 6, wherein each of said side rail members includes a generally inverted T-shaped slot therein, and wherein each of said seat members includes first and second spaced, enlarged, end portions slideably received in the respective inverted T-shaped slots of said first and second side rail members.

8. A multiple seat chair structure according to claim 7, wherein each of said seat sections includes a back rest portion thereon, and wherein said first and second side rail members and said seat member extend upwardly from rear portions thereof to form said back rest portion.

9. A multiple seat chair structure according to any one of claims 1 to 3, wherein said chair structure includes a third seat section, two longitudinally spaced intermediate support members and at least two fittings, wherein said third seat section is positioned between said first and second seat sections, wherein the second side rail member of said first seat section and the first side rail member of said second seat section are fixed to and supported by different ones of said fittings, wherein the first side rail member of said third seat section and the second side rail member of said first seat section are fixed to and supported by the same one of said fittings, wherein the second side rail member of said third seat section and the first side rail member of said second seat section are fixed to and supported by the same other one of said fittings; and wherein said same one of said fittings is positioned between said first and third seat sections and said same other one of said fittings is positioned between said third and second seat sections.

10. A multiple seat chair structure according to claim 9, wherein the second side rail member of said first seat section and the first side rail member of said third seat section are integral with one another, and wherein the second side rail member of said third seat section and the first side rail member of said second seat section are integral with one another.

11. A multiple seat chair structure according to claim 10, wherein each of said side rail members includes a generally inverted T-shaped slot therein, and wherein each of said seat members includes first and second spaced, enlarged, end portions slideably received in the respective inverted T-shaped slots of said first and second side rail members.

12. A multiple seat chair structure according to claim 11, wherein each of said seat sections includes a back rest portion thereon, and wherein said first and second side rail members and said seat member extend upwardly from rear portions thereof to form said back rest portion.

13. A multiple seat chair structure having a pair of longitudinally spaced, vertically oriented, end support members adapted to rest on a floor, each of said members including transversely spaced, vertically extending, front and rear leg portions, said chair structure comprising transversely spaced front and rear brace members fixed to and interconnecting the respective front and rear leg portions of said end support members, at least one vertically oriented, generally U-shaped, intermediate support member adapted to rest on the floor, each of said intermediate support members being positioned between and longitudinally spaced from each of said end support members, said intermediate support members each including a generally vertically oriented front leg portion and a generally vertically oriented rear leg portion, respective first means for fastening the upper ends of said front leg portions of said intermediate support members to said front brace member, respective second means for fastening the upper ends of said rear leg portions of said intermediate support members to said rear brace member, and at least a first and a second seat section, each of said seat sections including longitudinally spaced first and second side rail members and a seat member extending between and supported by said side rail members, the first side rail member of said first seat section being fixed to and supported by one of said end support members, and the second side rail member of said first seat section being fixed to and supported by the front and rear legs of one of said intermediate support members, the second side rail member of said second seat section being fixed to and supported by the other of said end support members, and the first side rail member of said second seat section being fixed to and supported by the front and rear legs of one of said intermediate support members, and wherein at least one of said fastening means includes respective support surfaces thereon for fixedly receiving thereon one or the other of said front and rear brace members, one or the other of said front and rear leg portions of one of said intermediate support members, and a side rail member from each of two of said seat sections.

14. A multiple seat chair structure according to claim 13, wherein said chair structure includes two seat sections and one intermediate support member, wherein the second side rail of said first seat section and the first side rail of said second seat section are located centrally of the chair seat structure, and wherein the second side rail member of said first seat section and the first side rail member of said second seat section are fixed to and supported by the front and rear legs of the same intermediate support member.

15. A multiple seat chair structure according to claim 14, wherein the second side rail member of said first seat section and the first side rail member of said second seat section are integral with one another.

16. A multiple seat chair structure according to claim 13, wherein said chair structure includes a third seat section and two longitudinally spaced intermediate support members, wherein said third seat section is positioned between said first and second seat sections, wherein the second side rail member of said first seat section and the first side rail member of said second seat section are fixed to and supported by the front and rear legs of different ones of said intermediate support members, wherein the first side rail member of said third seat section and the second side rail member of said first seat section are fixed to and supported by the front and rear legs of the same intermediate support member, and wherein the second side rail member of said third seat section and the first side rail member of said second seat section are fixed to and supported by the front and rear legs of the same intermediate support member.

17. A multiple seat chair structure according to claim 15, wherein the second side rail member of said first seat section and the first side rail member of said third seat section are integral with one another, and wherein the second side rail member of said third seat section and the first side rail member of said second seat section are integral with one another.

18. A multiple seat chair structure having a pair of longitudinally spaced, vertically oriented, end support members each of which includes a transversely extending lower portion adapted to rest on a floor, each of said end support members including a transversely extending upper portion and transversely spaced, vertically extending, front and rear leg portions interconnecting corresponding ends of said upper and lower portions, said chair structure comprising transversely spaced front and rear brace members fixed to and interconnecting the respective front and rear leg portions of said end support members intermediate said upper and lower portions thereof, and an intermediate brace member fixed to and interconnecting the lower portions of said end support members, said chair structure further including at least one vertically oriented, generally U-shaped, intermediate support member adapted to rest on a floor, each of said intermediate support members being positioned between and longitudinally spaced from each of said end support members, said intermediate support members each including a generally vertically oriented front leg portion, a generally vertically oriented rear leg portion, and a transversely extending lower portion adapted to rest on the floor and fixed to and interconnecting the lower ends of said front and rear leg portions, said transversely extending lower portions of said intermediate support members being fixed to said intermediate brace member, respective first means for fastening the upper ends of said front leg portions of said intermediate support members to said front brace member, respective second means for fastening the upper ends of said rear leg portions of said intermediate support members to said rear brace member, and at least a first and a second seat section, each of said seat sections including longitudinally spaced first and second side rail members and a seat member extending between and supported by said side rail members, the first side rail member of said first seat section being fixed to and supported by one of said end support members and the second side rail member of said first seat section being fixed to and supported by the front and rear legs of one of said intermediate support members, the second side rail member of said second section being fixed to and supported by the other of said end support members, and the first side rail member of said second seat section being fixed to and supported by the front and rear legs of one of said intermediate support members, and wherein at least one of said fastening means includes respective support surfaces thereon for fixedly receiving thereon one or the other of said front and rear brace members, one or the other of said front and rear leg portions of one of said intermediate support members, and a side rail member from each of two of said seat sections.

19. A multiple seat chair structure according to claim 18, wherein said chair structure includes two seat sections and one intermediate support member, wherein the second side rail of said first seat section and the first side rail of said second seat section are located centrally of the chair seat structure, and wherein the second side rail member of said first seat section and the first side rail member of said second seat section are fixed to and supported by the front and rear legs of the same intermediate support member.

20. A multiple seat chair structure according to claim 19, wherein the second side rail member of said first seat section and the first side rail member of said second seat section are integral with one another.

21. A multiple seat chair structure according to claim 18, wherein said chair structure includes a third seat section and two longitudinally spaced intermediate support members, wherein said third seat section is positioned between said first and second seat sections, wherein the second side rail member of said first seat section and the first side rail member of said second seat section are fixed to and supported by the front and rear legs of different ones of said intermediate support members, wherein the first side rail member of said third seat section and the second side rail member of said first seat section are fixed to and supported by the front and rear legs of the same intermediate support member, and wherein the second side rail member of said third seat section and the first side rail member of said second seat section are fixed to and supported by the front and rear legs of the same intermediate support member.

22. A multiple seat chair structure according to claim 21, wherein the second side rail member of said first seat section and the first side rail member of said third seat section are integral with one another, and wherein the second side rail member of said third seat section and the first rail side member of said second seat section are integral with one another.

23. A multiple seat chair section according to any one of claims 18–22, wherein each of said fastening means includes respective support surfaces therein for fixedly receiving thereon one or the other of said front and rear brace members, one or the other of said front and rear leg portions of one of said intermediate support members, and a side rail member from each of two of said seat sections.

* * * * *

UNITED STATES PATENT AND TRADEMARK OFFICE

CERTIFICATE OF CORRECTION

PATENT NO. : 4,848,843

DATED : July 18, 1989

INVENTOR(S) : Terence E. Gibbs

It is certified that error appears in the above-identified patent and that said Letters Patent is hereby corrected as shown below:

Column 9, line 40 "15" should read --16--.

Signed and Sealed this

Tenth Day of July, 1990

*Attest:*

HARRY F. MANBECK, JR.

*Attesting Officer*

*Commissioner of Patents and Trademarks*